United States Patent [19]

Nelson

[11] 4,037,839

[45] July 26, 1977

[54] COLLAPSIBLE BATON

[76] Inventor: Norman C. Nelson, P.O. Box K, Barstow, Calif. 93211

[21] Appl. No.: 645,667

[22] Filed: Dec. 31, 1975

[51] Int. Cl.[2] ..... F41B 15/02

[52] U.S. Cl. ..... 273/84; 403/109; 403/166; 403/322

[58] Field of Search ..... 273/69, 80 D, 84 R; 124/16, 37; 403/109, 166, 322

[56] References Cited

U.S. PATENT DOCUMENTS

| | | | |
|---|---|---|---|
| 1,094,226 | 4/1914 | Duc | 273/84 R |
| 1,157,909 | 10/1915 | Teague | 273/69 |
| 1,334,188 | 1/1920 | Swan | 273/84 R |
| 1,909,932 | 5/1933 | Digel | 273/84 R |
| 2,218,825 | 10/1940 | Guillou | 273/69 X |
| 2,757,002 | 7/1956 | Ryden | 273/80 D X |
| 2,838,266 | 6/1958 | Rees | 403/166 X |
| 3,480,310 | 11/1969 | McElwain | 403/322 |
| 3,822,951 | 7/1974 | Bornzin | 403/322 X |

FOREIGN PATENT DOCUMENTS

| | | | |
|---|---|---|---|
| 418,616 | 10/1910 | France | 273/80 D |
| 356,481 | 7/1922 | Germany | 273/84 R |
| 1,187,979 | 4/1970 | United Kingdom | 273/84 R |

OTHER PUBLICATIONS

Washington Post, May 31, 1970.

*Primary Examiner*—Richard J. Apley
*Attorney, Agent, or Firm*—Allan D. Mockabee

[57] ABSTRACT

A police baton or the like of telescoping tubular sections normally carried in a collapsed telescoped condition and extensible by releasing a safety lock in the handle and exerting pressure upon an eject button to release a catch and permit an internal expansive helical spring to telescopically extend the sections of the baton, operation of the safety lock and of the eject button being accomplished by movement of those elements in readily distinguishable directions of operational motion.

13 Claims, 8 Drawing Figures

COLLAPSIBLE BATON

The invention relates to a police baton which in its normal condition of use may be approximately the length of the conventional one-piece wand baton generally carried by police officers. It is arranged so that it can be extended to considerably more than its normal length when desired or necessary under certain conditions in police work. The normal collapsed position makes it convenient to carry and handle but when extended it greatly increases the effective reach of the implement. In its extended position it can be used as an elongated pole or wand to facilitate holding back of crowds of people and also in that position it can be used to ward off an attacker or other person without having to approach too closely to him.

Some of the objects and advantages of the invention will appear from the following description in connection with the accompanying drawings wherein.

Figure 6:
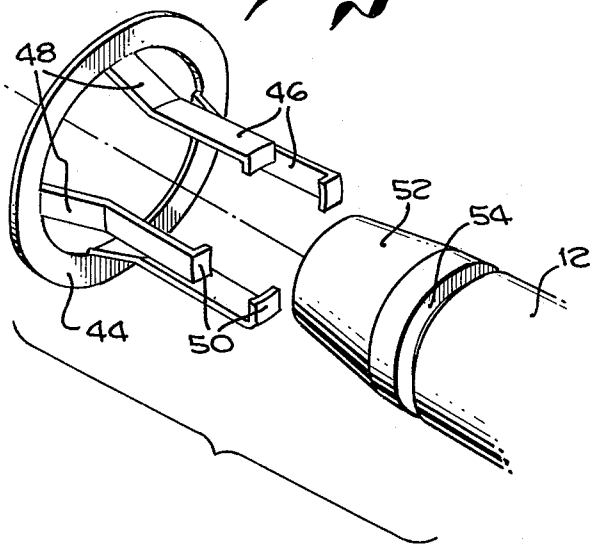

FIGS. *5a, 5b* and *5c* considered together show respectively, the handle end, the intermediate portion, and the outer or extended portion of the baton in the extended position thereof;

FIG. 6 is an exploded perspective view of the spring catch means and the inner end of the baton section it is adapted to releaseably engage.

The implement as illustrated includes a radially outer tubular portion 8 which comprises the handle end of the baton, an intermediate tubular portion 10 and a radially inner tubular portion 12 which comprises the longitudinally outermost section of the wand when it is extended. The inside end wall of the handle section 8 is tapered inwardly as at 14. The longitudinally inner end of the intermediate section 10 has the outer wall thereof flared slightly from right to left as viewed in FIG. 1 so that when the intermediate section is extended outward relative to the handle section 8 the tapered or flared surfaces 14 and 16 will come into engagement and limit longitudinal elongation of the two telescoping sections. The inner wall of the right end of the intermediate section 10 is provided with an inward taper 18 to cooperate with an outward taper 20 on the outer wall of the inner tubular section 12 at a point spaced longitudinally from the left end of said inner section. When said radially inner section 12 is extended from the intermediate section 10, the enlarged taper 20 on the outside of the left end portion of section 12 will engage the reduced taper 18 on the inner wall of the intermediate section 10 at the right end thereof.

Threaded into the right end of the radially inner tubular section 12 is a plug 22 having a protruding knob 24. Extending to the left through the interior of the radially inner tubular section 12 is a rod 26 upon which is a helical expansion spring 28. The right end of spring 28 bears against the threaded plug 22 and the left end of said spring bears against a cam plate 30 mounted on the threaded end 32 of rod 26 which also carries an eject button 34 which is the manual actuator of a catch element to be described.

The extreme left end of the radially outer telescoping sleeve 8 has a collar 38 threaded thereon. The collar has a central opening 40 to receive and guide a boss 42 which is part of the eject button 34 and which is threaded upon the threaded end of the stem 32. Between the collar 38 and the left end of the tubular section 8 is a spring catch ring 44 which has four spring arms 46 extending therefrom. Each of said arms includes a slanting portion 48 and an inwardly turned end 50. When the baton is collapsed the radially inward tubular section 12 will be pushed inwardly toward the spring catch arms 46. The left end of the tubular section 12 is tapered as shown at 52 in FIG. 6 and the inwardly bent ends 50 of the spring catch arms 46 are adapted to ride up the tapered surface and lodge in a groove 54 formed about the tubular section 12.

Figure 1:
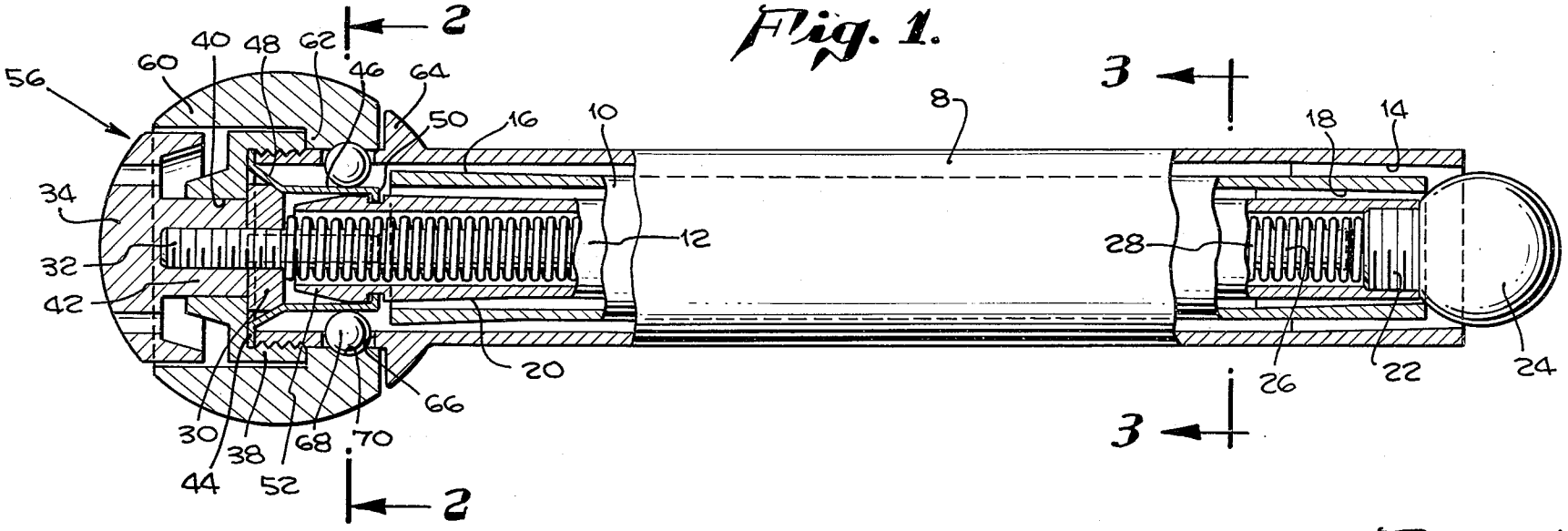
FIG. 1 is an elevational view of an embodiment thereof with portions in section to show interior structure.

When the eject button 34 is pressed in, the cam plate 30 will move from left to right and in so doing will engage the slanted portions 48 of the spring arms 46 and urge the arms radially outwardly so that their bent ends 50 will be removed from the circumferential groove 54 about the tubular section 12. The expansion spring 28 which is at that time under compression as shown in FIG. 1, will move the radially inner tubular section 12 to the right and it in turn will engage the right end of the intermediate tubular section 10 and urge it to the right until its tapered surface 16 engages tapered surface 14 of the radially outer or handle section 8 and the baton will be extended to its greatest limit. As soon as finger pressure is removed from the eject button 34 the spring 28 will move the cam plate 30, stem 32 and eject button 34 to the left to the position of FIG. *5a,* the position of the cam plate 30 then being such that the spring catch fingers 46 can move radially inwardly to be in position to engage the end of the radially inner tube 12 when the baton is telescopically collapsed and also permit the ends 50 of the catch fingers to seat in the groove 54.

The handle of the baton is indicated generally at 56. This handle includes a partially rotatable ring 60 having an inwardly directed shoulder portion 62 lying between the threaded collar 38 and a circumferential shoulder portion 64 on the radially outer telescoping tube section 8. A left end portion of the tube section 8 is provided with four apertures 66 in each of which lies a ball 68. The inwardly directed shoulder 62 of the locking ring 60 is provided with cam depressions 70 and 72 in the position of the device shown in FIGS. 1 and 2 the balls 68 lie in the more shallow cam depressions 70. In this position the balls 68 are cammed radially inwardly slightly to bear against the spring catch fingers 46 and hold their bent ends 50 in the groove 54 about the outer wall of the radially inner tube section 12.

Figure 4:
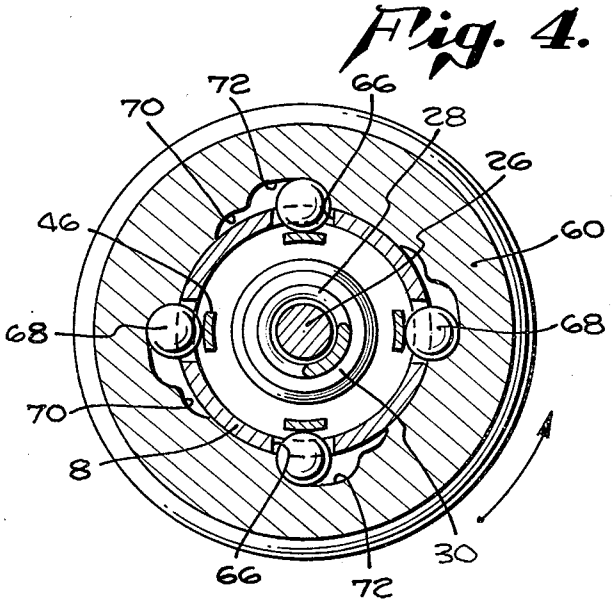
FIG. 4 is a section similar to that of FIG. 2 but with the safety lock in a different position.
Figure 2:
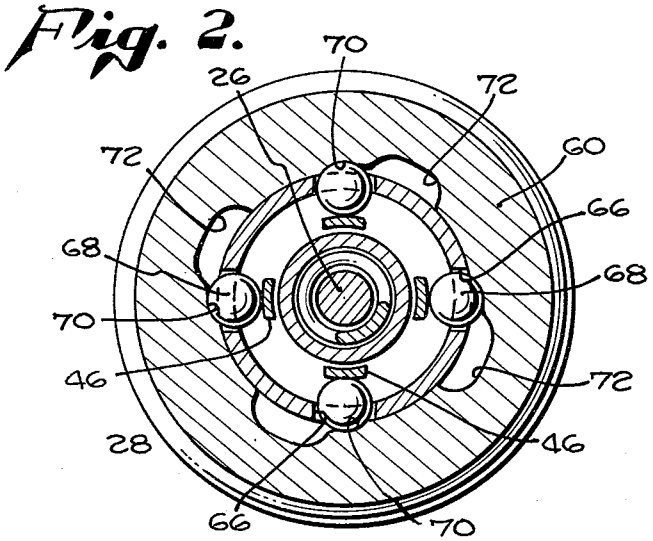
FIG. 2 is a section taken approximately on the line 2—2 of FIG. 1.
Figure 5A:
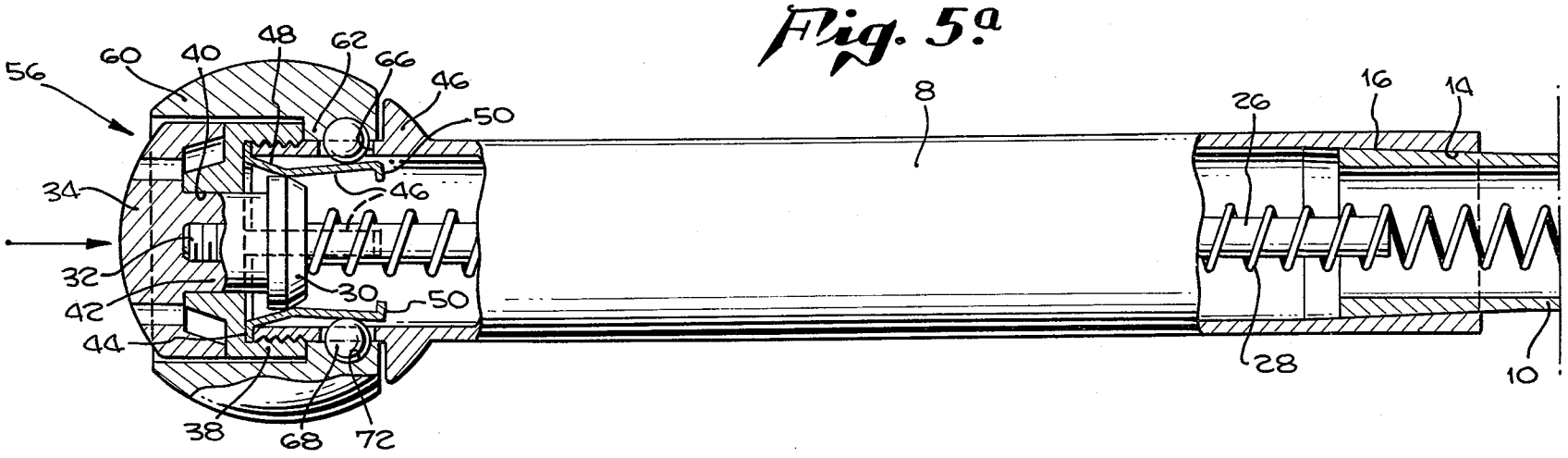
Figure 5B:
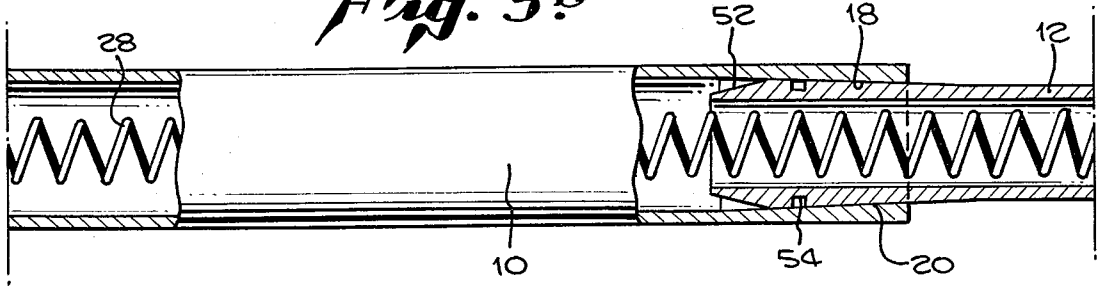
Figure 5C:
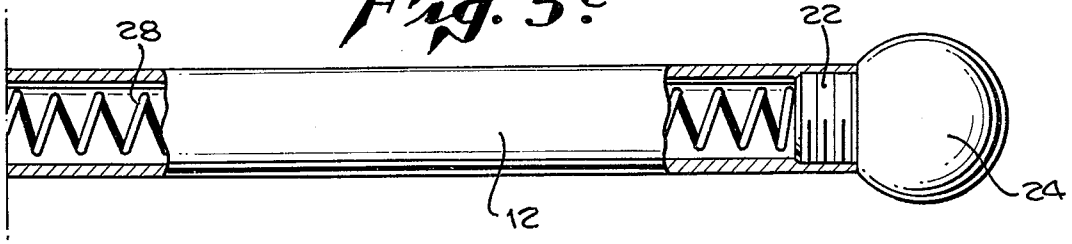

When the locking ring which might be termed a safety lock ring 60 is rotated from the position of FIG. 2 to that of FIG. 4 in a counterclockwise direction the balls 68 will unseat from the shallower cam depressions 70 and the deeper cam depressions 72 will be in position to receive the balls.

The strength of the expansion spring 28 is such that the tendency of the radially inner tubular section 12 to move to the right under the influence of the spring is great enough to cause the bent ends 50 of the spring fingers 46 to be frictionally held in the circumferential groove 54 so that dislodgement of the spring fingers is necessary. This is accomplished by pressure or a blow of the hand against the eject button 34 which will move the cam plate 30 to the right and force the spring catch fingers 46 radially outwardly. Of course when the baton is collapsed the radially inner tubular section 12 will move to the left causing the bent ends 50 of the spring catch fingers 46 to snap into the groove 54 due to the inherent resilience of the spring arms 46, since there is no frictional force to resist movement of the spring arms at this time.

Figure 3:
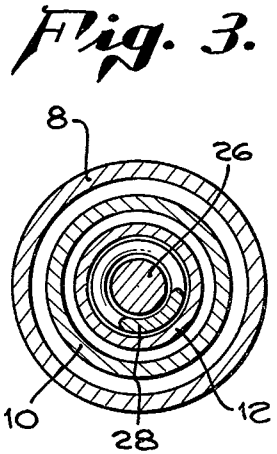
FIG. 3 is a section taken approximately on the line 3—3 of FIG. 1.

When the baton is collapsed the safety lock ring 60 is rotated partially in a clockwise direction as viewed in FIG. 4. The balls 68 will ride out of the deeper cam depressions 72 and into the shallower depressions 70. This moves the balls 68 radially inwardly. The balls are so positioned at this time that they will engage the spring catch fingers 46 in the manner shown in FIGS. 1 and 3 and hold the fingers and their bent ends 50 so that the ends cannot become dislodged from the groove 54 in which the bent ends are located.

The baton, when collapsed, is quite compact and convenient to carry or to hang on the officer's belt. When in use and its extension is desired, this can be accomplished quickly and conveniently but with two simple but quite different movements. The first is a slight twisting movement of the safety lock ring 60 followed by pressure or a slight blow against the eject button 34. Thereupon the baton will extend telescopically practically instanteously under the influence of the spring 28. While quick and convenient extension of the wand is highly desirable, the slight twisting movement to release the safety lock does not cause any appreciable delay in the desired extension of the baton.

It should be noted that the movement of the safety lock ring 60 is circumferentially of the handle 56 and that movement of the eject button 34 is axially of the handle. Thus, there are two quite distinctly indentifiable and recognizable movements with which the officer readily becomes acquainted so that he will, after a period of practice, turn the safety lock ring and then press the eject button.

It should of course be understood that various changes can be made in the form, details, arrangement, and proportions of the various parts without departing from the spirit of the invention.

I claim:

1. A police baton comprising, at least a pair of telescoping tubes movable to extend and collapsed positions, cooperating separably engageable stop portions adjacent the inner end of one tube and the outer end of the other tube to limit the extended movement of the tubes, one of the tubes having a handle end, spring means interposed between one of said handle end and its tube and the other tube and biasing said other tube to an extended position, a catch device carried by said one of said handle and one of said tubes and releasably engaging said other tube for extension by said spring means, and a safety lock associated with said catch device to releasably secure the catch device against release from said other tube.

2. The structure in claim 1, and said telescoping tubes comprising an outer tube attached to said handle end, an inner tube within said outer tube, said spring means being disposed in said inner tube between a portion of the inner tube and said handle end, and said catch being carried by said handle end.

3. The structure in claim 1, and said safety lock and said catch device having distinctly identifiable types of actuating movement.

4. The structure in claim 1, and actuators for said safety lock and said catch device having distinctly identifiable movement.

5. A police baton comprising, at least a pair of telescoping tubes movable to extended and collapsed positions, cooperating separably engageable stop portions adjacent the inner end of one tube and the outer end of the other tube to limit the extended movement of the tubes, one of the tubes having a handle end, spring means interposed between one of said handle end and its tube and the other tube and biasing the other tube to an extended position, a catch device carried by said one of said handle and one of said tubes and releasably engaging said other tube for extension by said spring means, and said other tube having an abutment facing generally towards the direction of extension of said other tube, a catch element movable into and out of abutment engaging position, and an actuator for said catch element to move it out of abutment engaging position.

6. The structure in claim 5, and said catch actuator being movable in the direction of extension of said other of said tubes.

7. The structure in claim 6, and a safety lock at said handle end of said one tube, and said safety lock having an actuator movable in a direction other than the direction of movement of said catch actuator.

8. A police baton comprising, a pair of telescoping first and second tube units, the first tube being relatively stationary and having a handle end with a handle thereon, the second tube lying within the first tube and its extensible longitudinally therein, means associated with said tubes for limiting telescoping extension thereof, the second tube unit having an inner end adjacent said handle when the baton is collapsed, said inner end of the second tube having abutment means facing generally toward the outer end of said tube, a catch element carried by said handle normally biased to a position to be engaged by said abutment means and prevent outward extension of the second tube, and an actuator carried by said handle and movable relative thereto to shift said catch element away from said abutment means.

9. The structure in claim 8, and said abutment means extending continuously about said second tube, said catch element comprising fingers having cam surfaces thereon, and said actuator comprising a cam member engageable with said cam surfaces to displace said fingers from said abutment means.

10. The structure in claim 9, and said catch actuator also including an operating element connected to said cam member and having a finger contact surface exposed exteriorly of said handle.

11. The structure in claim 9, and a safety lock carried by said handle and associated with said catch element to releaseably secure the catch element, the catch element being biased to move from a radially inward abutment engaging position to a radially outward position free of said abutment, the safety lock including an operating ring carried by and rotatable partially about said handle, and cam means interposed between said operating element of said safety lock and said catch element to alternately radially inwardly depress said catch element and release the catch element for radially outward biased movement.

12. The structure in claim 11 and said cam unit comprising a cam follower in engagement with said catch element, an the interior of said partially rotatable ring having an inner portion comprising a cam surface a part of which extends radially inwardly sufficiently to cause said cam follower to hold said catch element into abutment engaging position upon rotation of said ring to one position, and said cam surface having another portion extending radially inwardly to a lesser degree to permit said catch element to flex it and said cam follower radially outwardly with the catch element out of engagement with said abutment.

13. The structure in claim 8, and a safety lock carried by said handle movable from an "off" position to an "on" position to releaseably hold said catch element against movement from said abutment means by said catch actuator.

* * * * *